United States Patent [19]

Herzog

[11] Patent Number: 4,967,812

[45] Date of Patent: Nov. 6, 1990

[54] NOZZLE DRIP COLLECTING PAN

[76] Inventor: Kenneth J. Herzog, 200 Mill Rd., Riverhead, N.Y. 11901

[21] Appl. No.: 433,113

[22] Filed: Nov. 8, 1989

[51] Int. Cl.[5] ..... B67C 3/02

[52] U.S. Cl. ..... 141/88; 141/87; 141/311 A; 141/284; 222/108; 137/312; 239/120

[58] Field of Search ..... 141/86, 87, 88, 311 A, 141/284, 251, 263; 222/108, 109; 137/312, 313; 239/120, 121, 122

[56] References Cited

U.S. PATENT DOCUMENTS

| | | | |
|---|---|---|---|
| 1,675,741 | 7/1928 | Waring | 141/87 X |
| 2,874,733 | 2/1959 | Sesler et al. | 141/87 |
| 2,874,734 | 2/1959 | Luckock et al. | 141/87 |
| 3,087,517 | 4/1963 | Magnuson et al. | 141/88 X |
| 4,337,802 | 7/1982 | Kennedy et al. | 141/87 X |
| 4,515,187 | 5/1985 | Schaumburg et al. | 141/87 X |

*Primary Examiner*—Ernest G. Cusick

[57] ABSTRACT

A drip pan protector for a nozzle in a container filling machine that includes a drip pan carried on two swing arms which will go under the nozzle to catch liquid drippings when the nozzle moves up after filling a container and will move away from under the nozzle when the nozzle moves down to fill the container.

4 Claims, 1 Drawing Sheet

POSITION A
POSITION B

NOZZLE DRIP COLLECTING PAN

BACKGROUND OF THE INVENTION

The instant invention relates generally to container filling machines and more specifically it relates to a drip pan protector for a nozzle in a container filling machine.

Numerous container filling machines have been provided in prior art that are adapted to include nozzles for filling containers with liquids that may drip after going through the filling cycles.

While these units may be suitable for the particular purpose to which they address, they would not be as suitable for the purposes of the present invention as heretofore described.

SUMMARY OF THE INVENTION

A primary object of the present invention is to provide a drip pan protector for a nozzle in a container filling machine that will overcome the shortcomings of the prior art devices.

Another object is to provide a drip pan protector for a nozzle in a container filling machine in which the drip pan protector will go under the nozzle to catch the liquid dripping when the nozzle moves up after filling containers.

An additional object is to provide a drip pan protector for a nozzle in a container filling machine in which the drip pan protector will move away from under the nozzle when the nozzle moves down into a container to fill.

A further object is to provide a drip pan protector for a nozzle in a container filling machine that is simple and easy to use.

A still further object is to provide a drip pan protector for a nozzle in a container filling machine that is economical in cost to manufacture.

A further object is to eliminate air driven mechanisms that may fail with an accidental cut-off of air supply and prevent the nozzle from hitting the drip pan.

Further objects of the invention will appear as the description proceeds.

To the accomplishment of the above and related objects, this invention may be embodied in the form illustrated in the accompanying drawings, attention being called in the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3:
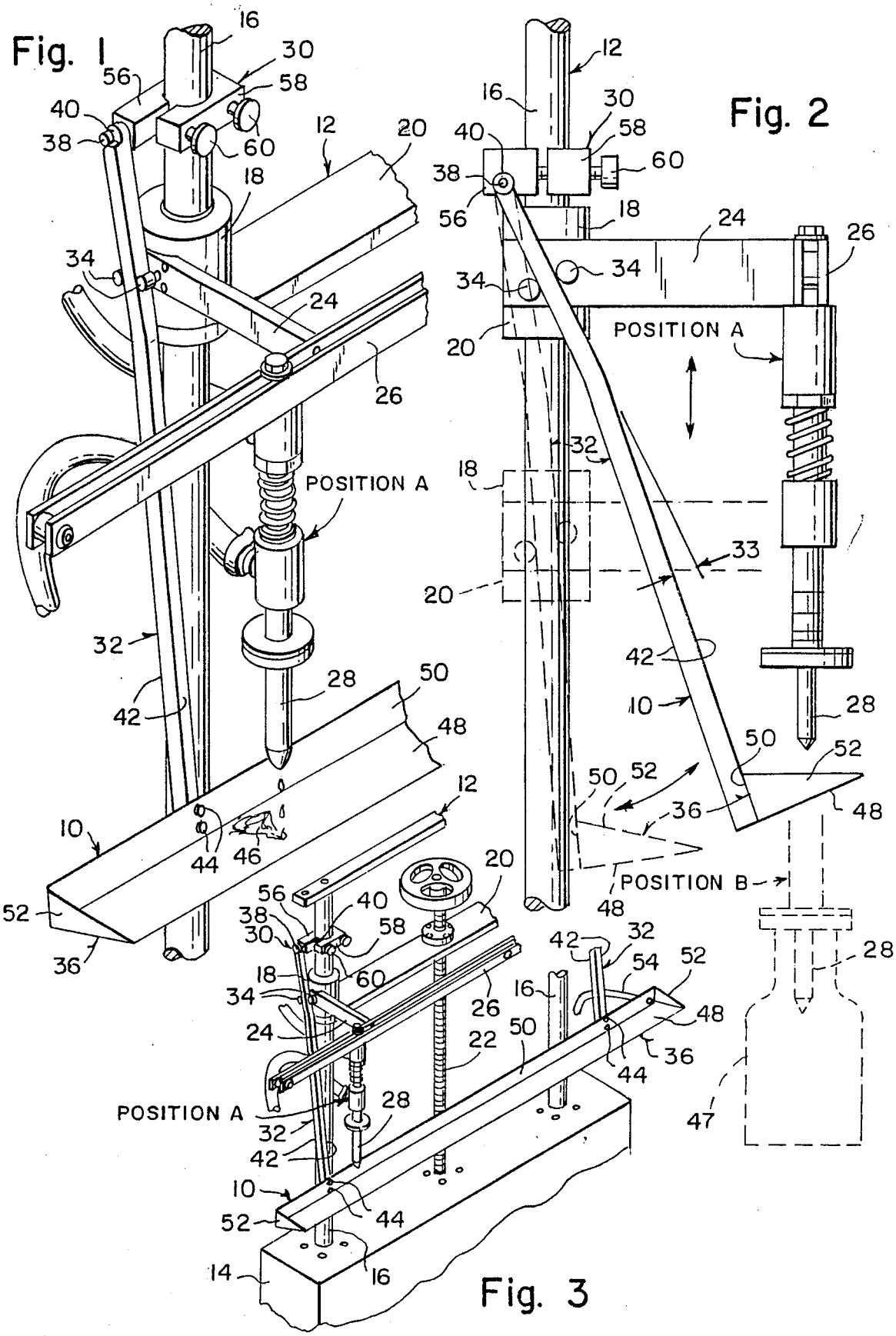
FIG. 1 is a perspective view of the invention.
FIG. 2 is a side view thereof showing a moved down position in phantom.
FIG. 3 is a perspective view similar to FIG. 1, showing the drive rod and housing.

Turning now descriptively to the drawings, in which similar reference characters denote similar elements throughout the several views, FIGS. 1 through 3 illustrate a drip pan protector 10. A container filling machine 12 is shown that has a housing 14, a pair of spaced apart guide shafts 16 extending vertically upward on the housing 14. A pair of sleeve 18 (only one illustrated) are each sliding on one shaft 16. A support arm 20 extends horizontally between the sleeves 18 while a drive rod 22 extends vertically from within the housing 14, is attached to the support arm 20 and is driven by a mechanism (not shown) within the housing 14. A pair of brace members 24 (only one illustrated are provided with each extending horizontally from one of the sleeves 18 transversely from the support arm 20. A rack member 26 is carried on the brace members 24 and at least one nozzle 28 is suspended vertically down from the rack member 26.

The pan protector 10, being the invention, includes a pair of mounting brackets 30 (only one illustrated), a pair of swing arms 32, two sets of cam followers 34 (only one set illustrated) and a drip pan 36.

Each bracket 30 is affixed near top of one of the guide shafts 16. Each swing arm 32 bent at a predetermined angle 33 is pivotly mounted at upper end via a shoulder screw 38 and washer 40 to one of the mounting brackets 30. Each set of cam followers 34 are affixed to one of the brace members 24 so that each cam follower 34 will ride along one side 42 of one swing arm 32 for movement thereof. The drip pan 36 is affixed to lower ends of the swing arms 32 by button head screws 44. When the nozzle 28 goes into an up non-operable position "A", the drip pan 36 will go directly under the nozzle 28 to catch any liquid 46 dripping from the nozzle. When the nozzle 28 goes into a down operable position "B", (see FIG. 2) to fill a container 47, the drip pan 36 will move backward away from under the nozzle 28 allowing the nozzle to enter the container 47.

The drip pan 36 is an elongated scoop member that includes a bottom wall 48, a rear wall 50 and a pair of triangular shaped side walls 52. A hose line 54 extends from one end of the rear wall 50 to drain away any excess liquid 46 that drips from the nozzle 28.

Each mounting bracket 30 includes a rear split collar mounting block 56 in which the upper end of one of the swing arms 32 is pivotly mounted thereto. A front split collar mounting block 58 is also provided. A pair of retainment screws 60 are threaded into both the front split collar mounting block 58 and the rear split collar mounting block 56 for securement to the guide shaft 16.

When the nozzle 28 is in position "A", the sleeves 18 are moved up causing the swing arms 32 to go in with the drip pan 36 under the nozzle. When the nozzle 28 is in position "B", the sleeves 18 are moved down causing the swing arms 32 to go back pulling the drip pan 36 away.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A drip pan protector for a container filling machine of the type having a housing, a pair of spaced apart guide shafts extending vertically upwardly on the housing, a pair of sleeves, each pair of sleeves sliding on one of said pair of shafts, a support arm extending horizontally between the pair of sleeves, a drive rod extending vertically from within the housing, attached to the support arm and driven by an appropriate mechanism within the housing, a pair of brace members, each pair of brace members extending horizontally from one of the pair of sleeves transversely from the support arm, a rack member carried on the pair of brace members and at least one nozzle suspended vertically down from the rack member, said at least one nozzle being vertically movable between an up non-operable position and a down operable position, wherein said drip pan protector comprises:

(a) a pair of adjustable mounting brackets, each pair of brackets affixed near top of one of the pair of guide shafts;

(b) a pair of swing arms, each of said pair of swing arms pivotly mounted at upper end to one of said pair of mounting brackets;

(c) two pairs of cam followers, each pair of said cam followers affixed to one of the pair of brace members so that each one of said pair of cam followers will ride along one side of one of said pair of swing arms for movement thereof; and (d) a drip pan affixed to lower ends of said pair of swing arms so that when at least one nozzle goes into said up non-operable position, said drip pan will go directly under the at least one nozzle to catch any liquid dripping from the at least one nozzle and when the at least one nozzle goes into said down operable position to fill a container, said drip pan will move backward away from under the at least one nozzle allowing the at least one nozzle to enter the container.

2. A drip pan protector as recited in claim 1, wherein said drip pan is an elongated scoop member that includes a bottom wall, a rear wall and a pair of triangular shaped side walls.

3. A drip pan protector as recited in claim 2, further including a hose line extending from one end of said rear wall of said drip pan so as to drain away any excess liquid that drips from the at least one nozzle.

4. A drip pan protector as recited in claim 3, wherein each of said pair of mounting brackets includes:

(a) a rear split collar mounting block in which the upper end of one of said pair of swing arms is pivotly mounted thereto for vertical adjustment accommodation variations in container height and nozzle lengths;

(b) a front split collar mounting block; and (c) a pair retainment screws threaded into both said front split collar mounting block and said rear split collar mounting block for securement to each of the pair of guide shafts.

* * * * *